US012773037B2

(12) United States Patent
Franklin

(10) Patent No.: US 12,773,037 B2
(45) Date of Patent: Oct. 27, 2026

(54) DEVICE FOR STYLING HAIR AND METHOD OF STYLING HAIR

(71) Applicant: CACTUS PEPPER LLC, Murfreesboro, TN (US)

(72) Inventor: Marilyn Franklin, Murfreesboro, TN (US)

(73) Assignee: CACTUS PEPPER LLC, Memphis, TN (US)

( * ) Notice: Subject to any disclaimer, the term of this patent is extended or adjusted under 35 U.S.C. 154(b) by 396 days.

(21) Appl. No.: 18/311,669

(22) Filed: May 3, 2023

(65) Prior Publication Data

US 2024/0365945 A1 Nov. 7, 2024

(51) Int. Cl.
*A45D 8/34* (2006.01)
*A45D 7/00* (2006.01)

(52) U.S. Cl.
CPC ..... *A45D 8/34* (2013.01); *A45D 2007/004* (2013.01)

(58) Field of Classification Search
CPC ..... A45D 7/002; A45D 7/004; A45D 7/02; A45D 8/34; A45D 8/36; A45D 8/38; A45D 2/127; A45D 2/125; A45D 2/122; A45D 2/12; A45D 2/02; A45D 2/20; A45D 2/10; A45D 2/14; A45D 2/143; A45D 2/18; A45D 2/28; A45D 2/2435
See application file for complete search history.

(56) References Cited

U.S. PATENT DOCUMENTS 944,226 A * 12/1909 West ..... A45D 2/14 132/248
1,310,557 A 7/1919 Beadle
1,373,968 A * 4/1921 Mcclintock ..... A45D 2/20 132/245

(Continued)

FOREIGN PATENT DOCUMENTS

AU 715644 B3 * 2/2000 ..... A45D 2/14
CN 204273547 U 4/2015

(Continued)

OTHER PUBLICATIONS

Clarivate Analytics copyrighted translation of WO00/76358A1; international filing date Jun. 6, 2000 (Year: 2000).*

(Continued)

*Primary Examiner* — Rachel R Steitz
*Assistant Examiner* — Sarah Woodhouse
(74) *Attorney, Agent, or Firm* — Ballard Spahr LLP

(57) ABSTRACT

This disclosure relates to a device for styling hair. The device includes an elongated body extending along a longitudinal axis. The elongated body has an outer surface and a first end and a second end oppositely disposed. The elongated body is adapted to receive a plurality of hair strands wrapped around the outer surface between the first and second end. A strip extends along the longitudinal axis. The strip has an inner surface and a first and second end attached to the elongated body proximate to the first end of the elongated body. The inner surface of the strip and a portion of the outer surface of the elongated body define an (Continued)

opening. The opening has a length extending along the longitudinal axis. The opening is adapted to receive the plurality of hair strands and secure the hair strands between the inner surface and the portion of the outer surface.

19 Claims, 14 Drawing Sheets

(56) References Cited

U.S. PATENT DOCUMENTS

| | | | | | |
|---|---|---|---|---|---|
| 2,154,501 | A | | 4/1939 | Feldman | |
| 2,481,448 | A | * | 9/1949 | Schiller | A45D 2/18 132/248 |
| 2,847,015 | A | | 8/1958 | Davis | |
| 3,688,778 | A | * | 9/1972 | Budman | A45D 2/14 D28/37 |
| 3,835,871 | A | | 9/1974 | Roccanova | |
| 4,211,245 | A | * | 7/1980 | Coppola | A45D 2/24 132/253 |
| 4,284,091 | A | * | 8/1981 | Ehmann | A45D 6/145 132/252 |
| 4,955,401 | A | * | 9/1990 | Parsons | A45D 2/12 132/226 |
| 5,303,723 | A | | 4/1994 | Schach | |
| 5,309,928 | A | * | 5/1994 | Longoria | A45D 2/12 132/251 |
| 5,454,385 | A | | 10/1995 | George | |
| 5,564,445 | A | | 10/1996 | Query | |
| 6,006,759 | A | * | 12/1999 | Goodwin | A45D 2/127 132/250 |
| 6,363,945 | B1 | * | 4/2002 | Roberson | A45D 6/185 132/255 |
| 8,555,898 | B1 | | 10/2013 | Byrd | |
| 2008/0251094 | A1 | * | 10/2008 | Wells | A45D 2/148 132/226 |
| 2016/0058096 | A1 | * | 3/2016 | Simmons | A45D 8/36 2/207 |
| 2017/0156470 | A1 | | 6/2017 | Nardi | |
| 2018/0116323 | A1 | | 5/2018 | Davis | |
| 2019/0274406 | A1 | | 9/2019 | Litson | |
| 2020/0069024 | A1 | | 3/2020 | Hsu | |
| 2022/0022620 | A1 | | 1/2022 | Rubin | |
| 2022/0346515 | A1 | * | 11/2022 | Elkouby | A45D 7/00 |

FOREIGN PATENT DOCUMENTS

| | | | | | |
|---|---|---|---|---|---|
| DE | 7824671 | U1 | | 12/1978 | |
| GB | 190722711 | A | | 10/1908 | |
| GB | 483892 | A | * | 4/1938 | A45D 2/20 |

OTHER PUBLICATIONS

International Search Report and Written Opinion were mailed on Jul. 26, 2024 by the International Searching Authority for International Application No. PCT/US2024/027641 filed on May 2003 (Applicant—Cactus Pepper LLC) (13 pages).

Sanas Spider Hair Braider Tool Hair Braiding Hair Weave Twist; www.amazon.in; 1 page.

Shells Set of 2 Sport Braider Hairstyling Tool French Hair Braiding Tool With Instruction; www.amazon.in; 1 page.

Heatless Curling Rod Headband, Ienin Heatless Hair Curler, No Heat Hair Curler; www.amazon.com; 1 page.

Octocurl Heatless Hair Curler; www.amazon.com; 1 page.

Curlformers Hair Curlers Barrel Curls Styling Kit; www.amazon.com; 1 page.

Charliecurls Heatless Hair Curler Kit; www.amazon.com; 1 page.

Allstar Innovations the Sleep Styler Night-Time Hair Curlers; www.amazon.in; 1 page.

New & Upgraded Satin Flower Curl—Heatless Hair Curler; www.desertcart.us/products/87697862; 1 page.

* cited by examiner

DEVICE FOR STYLING HAIR AND METHOD OF STYLING HAIR

FIELD OF INVENTION

The invention concerns a device for styling hair. In particular, the invention concerns a hair curler for curling hair. The invention further concerns methods of styling hair using the device.

BACKGROUND

No-heat hair curlers are often worn for a long period of time to curl hair without heat damage. Often, eight or more individual curlers must be worn to curl a head of hair. Wrapping eight or more curlers may be time intensive, inconvenient, and a hassle. Many no-heat hair curlers have bands that must be worn around or over the head in order to properly anchor the curlers to the scalp, while other curlers require visible and unattractive clips to hold a curler in place near the root of the hair. Typically, these curlers are often uncomfortable and unflattering, and therefore, not designed to be worn for long periods of time or out in public. Further, many curlers are not adjustable or customizable to attain different curl diameters, and the length cannot be sized to properly fit different hair lengths. Many of these curlers only work with long hair.

Accordingly, there is still a need for a hair curler that can be discretely worn in public. Still further, there is a need for a hair curler that can be quickly wrapped, is comfortable to wear (especially while sleeping), allows for personalization with length and curl diameter, and is attractive to wear while still providing a natural curl. These needs and other needs are at least partially satisfied by the disclosed device for curling hair.

SUMMARY OF THE INVENTION

Disclosed herein is a device for styling hair, the device comprising an elongated body and a strip. The elongated body extends along a longitudinal axis. The elongated body has an outer surface and a first end and a second end oppositely disposed. The elongated body is adapted to receive a plurality of hair strands wrapped around the outer surface between the first end and the second end of the elongated body. The strip extends along the longitudinal axis. The strip has an inner surface and a first end and a second end attached to the elongated body proximate to the first end of the elongated body. The inner surface of the strip and a portion of the outer surface of the elongated body define an opening. The opening has a length extending along the longitudinal axis. The opening is adapted to receive the plurality of hair strands and secure the hair strands between the inner surface of the strip and the portion of the outer surface of the elongated body.

Also disclosed herein is a method of styling hair using the device. The method comprises pulling a first plurality of hair strands through the opening. The method comprises wrapping the first plurality of hair strands around the elongated body in a first direction. The method comprises securing the wrapped first plurality of hair strands with a fastener.

Additional aspects of the device for curling hair and method of styling hair will be set forth, in part, in the detailed description, and claims which follow, and in part will be derived from the detailed description, or can be learned by practice of the invention. It is to be understood that both the foregoing general description and the following detailed description are exemplary and explanatory only and are not restrictive of the device for curling hair and method of styling hair as disclosed.

DETAILED DESCRIPTION

Figure 1:
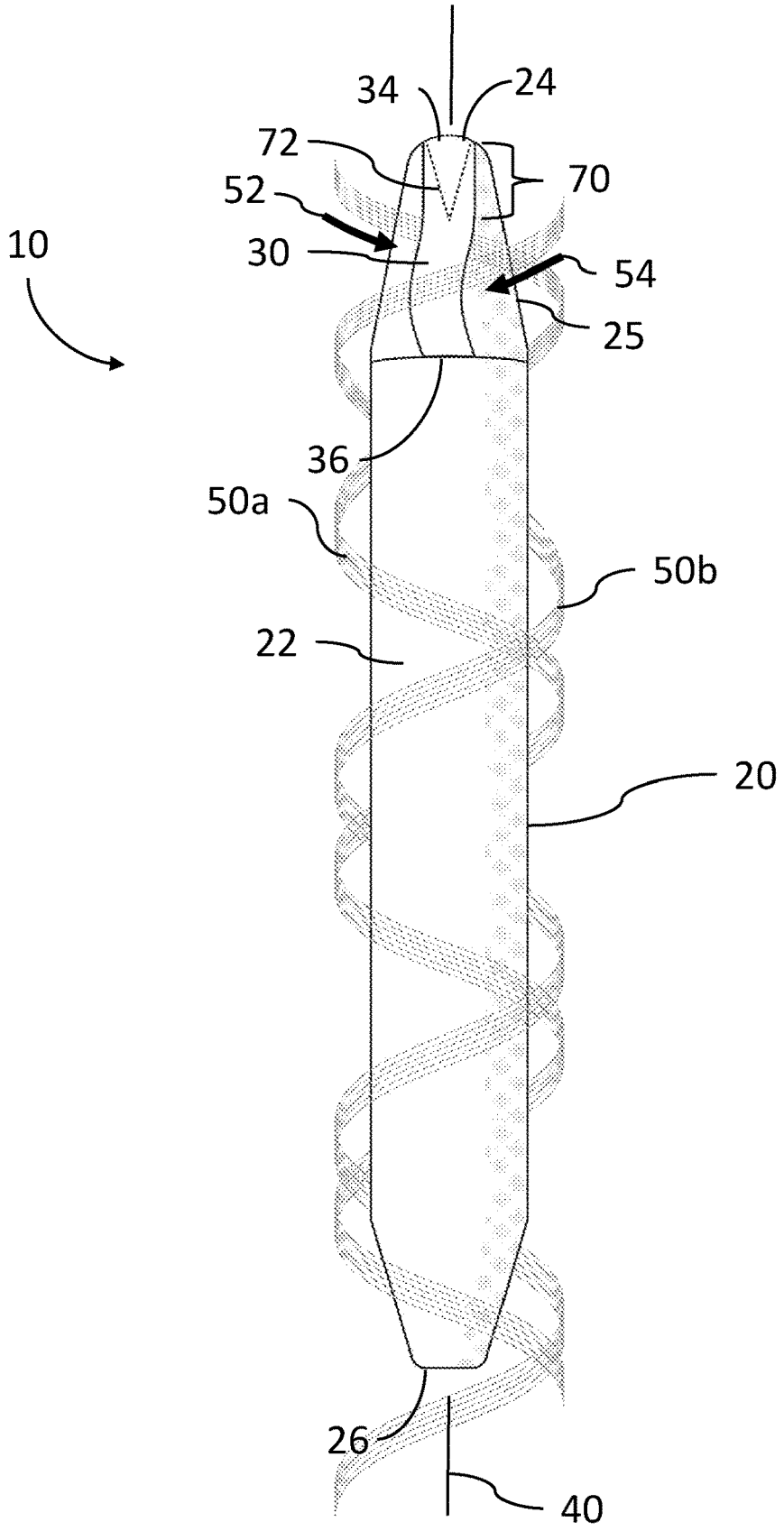
FIG. 1 shows a front view of an exemplary device for styling hair according to the invention.

The present invention can be understood more readily by reference to the following detailed description, examples, drawings, and claims, and their previous and following description. However, before the present compositions, articles, devices, systems, and/or methods are disclosed and described, it is to be understood that this invention is not limited to the specific compositions, articles, devices, systems, and/or methods disclosed unless otherwise specified, as such can, of course, vary. It is also to be understood that the terminology used herein is for the purpose of describing particular aspects only and is not intended to be limiting.

The following description of the invention is also provided as an enabling teaching of the invention in its best, currently known aspect. To this end, those of ordinary skill in the relevant art will recognize and appreciate that changes and modifications can be made to the various aspects of the invention described herein, while still obtaining the beneficial results of the present invention. It will also be apparent that some of the desired benefits of the present invention can be obtained by selecting some of the features of the present invention without utilizing other features. Accordingly, those of ordinary skill in the relevant art will recognize that many modifications and adaptations to the present invention are possible and can even be desirable in certain circumstances and are thus also a part of the present invention. Thus, the following description is provided as illustrative of the principles of the present invention and not in limitation thereof.

Various combinations of elements of this disclosure are encompassed by this invention, e.g. combinations of elements from dependent claims that depend upon the same independent claim.

It is also to be understood that the terminology used herein is for the purpose of describing particular aspects only and is not intended to be limiting. As used in the specification and in the claims, the term "comprising" may include the aspects "consisting of" and "consisting essentially of." Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used herein, the singular forms "a," "an" and "the" include plural referents unless the context clearly dictates otherwise. Thus, for example, reference to a "polymer" includes aspects having two or more polymers unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "optional" or "optionally" mean that the subsequently described event or circumstance may or may not occur, and that the description includes instances where said event or circumstance occurs and instances where it does not.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

While aspects of the disclosed device for styling hair and method of styling hair can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Disclosed herein is a device for styling hair, the device comprising: an elongated body extending along a longitudinal axis and having an outer surface and a first end and second end oppositely disposed, the elongated body is adapted to receive a plurality of hair strands wrapped around the outer surface between the first end and second end; and a strip extending along the longitudinal axis, the strip having an inner surface and a first end and second end attached to the elongated body proximate to the first end of the elongated body, the inner surface of the strip and a portion of the outer surface of the elongated body defining an opening having a length extending along the longitudinal axis, the opening adapted to receive the plurality of hair strands and secure the hair strands between the inner surface of the strip and the portion of the outer surface of the elongated body.

Also disclosed herein is a method of styling hair using the device for styling hair disclosed herein, the method comprising the following steps: pulling a first plurality of hair strands through the opening; wrapping the first plurality of hair strands around the elongated body in a first direction; and securing the wrapped first plurality of hair strands with a fastener.

Figure 2:
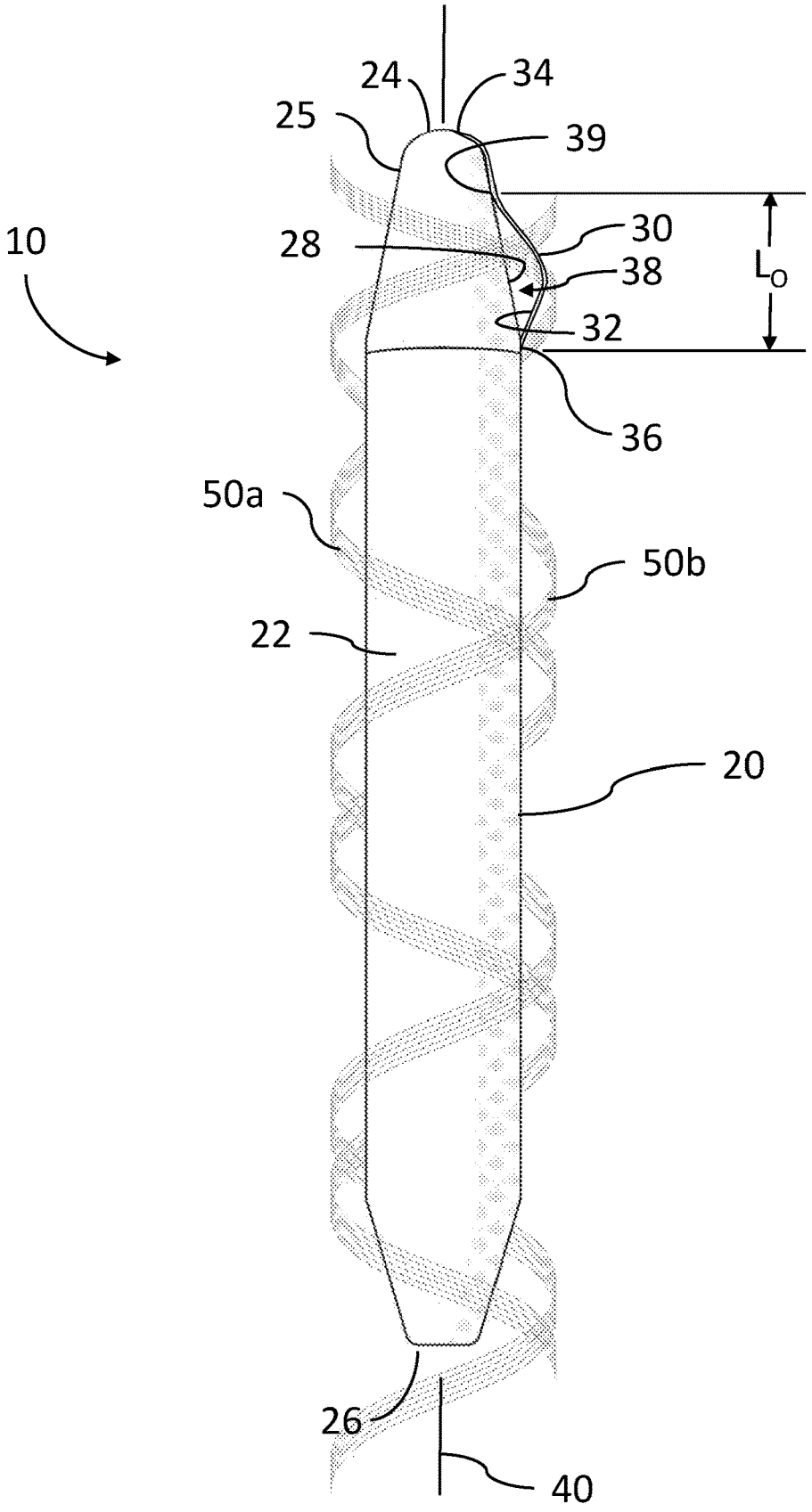
FIG. 2 shows a side view of the exemplary device for styling hair shown in FIG. 1.

FIGS. 1 and 2 show a non-limiting example device for styling hair 10 as disclosed herein. The device for styling hair 10 may be used to style hair. In one aspect, the device for styling hair 10 may be used for styling synthetic hair that would be damaged by heated curlers. Hair, including both real and synthetic hair, may appear curly, wavy, or blown out after using the device for styling hair 10. Further, hair may appear braided or twisted while using the device for styling hair 10. The device for styling hair 10 comprises an elongated body 20 and a strip 30. The elongated body 20 extends along a longitudinal axis 40. The elongated body 20 has an outer surface 22. The elongated body 20 has a first end 24 and a second end 26 oppositely disposed. The elongated body 20 is adapted to receive a plurality of hair strands 50*a*, 50*b* wrapped around the outer surface 22 between the first end 24 and the second end 26. In one aspect, a first plurality of hair strands 50*a* may be wrapped around the outer surface 22 in a first direction 52 and a second plurality of hair strands 50*b* may be wrapped around the outer surface 22 in a second direction 54 different than the first direction 52. In one aspect, the second direction 54 may be opposite from the first direction 52. Optionally, the first plurality of hair strands 50*a* may be wrapped around the outer surface 22 in a clockwise direction and the second plurality of hair strands 50*b* may be wrapped around the outer surface 22 in a counterclockwise direction. A portion 25 of the elongated body 20 may be tapered approaching the first end 24 of the elongated body 20 to prevent undesirable creasing or crimping of the wrapped hair 50*a*, 50*b* at the first end 24 of the elongated body 20. In one aspect, the portion 25 of the elongated body 20 may comprise additional and/or heavy weight fabric to prevent the elongated body 20 proximate to the first end 24 from bending and to provide support to the strip 30. In one aspect, the elongated body 20 may be comprised of an elastic material to provide workability to the user. In one aspect, at least a portion of the elongated body 20 may be made from a material that is known for good sliding friction properties to reduce hair breakage. In certain aspects, at least a portion of the elongated body may be made from at least one of a silk, a cotton, a polyester, a nylon, a rayon, a linen, a hemp, a lyocell, a modal, a bamboo, a medical grade PVC, a silicone material, or a microfiber. Optionally, at least a portion of the elongated body may be made from at least one of a satin weave, a plain weave, or a twill weave.

The strip 30 may be used to anchor the device for styling hair 10 to the user's scalp or to a wig cap. The strip 30 extends along the longitudinal axis 40. The strip 30 has a first end 34 and a second end 36 attached to the elongated body 20 proximate to the first end 24 of the elongated body 20. In one aspect, the first end 34 and second end 36 may be permanently attached to the elongated body 20. In certain aspects, the first end 34 and the second end 36 may be attached via stitching, gluing stapling, or adhesive. As shown in FIG. 2, the strip 30 has an inner surface 32 facing the outer surface 22 of the elongated body 20. The inner surface 32 of the strip 30 and a portion 28 of the outer surface 22 of the elongated body 20 define an opening 38. The opening 38 is adapted to receive the plurality of hair strands 50*a* and/or 50*b* and secure the hair strands 50*a* and/or 50*b* between the inner surface 32 of the strip 30 and the portion 28 of the outer surface 22 of the elongated body 20. For example, the first plurality of hair strands 50*a* is pulled through the opening 38 in the first direction 52 until the first end 24 of the elongated body 20 is positioned proximate to the roots of the plurality of hair strands 50*a* and the user's scalp or wig cap. The second plurality of hair strands 50*b* may be wrapped over the strip 30 in the second direction 54 thereby securing the device for styling hair 10 to the user's scalp or wig cap. The opening 38 has a length $L_O$ extending along the longitudinal axis 40. The length $L_O$ of the opening 38 may allow a user to pull the plurality of hair strands 50*a*, 50*b* through the opening 38. In one aspect, the length $L_O$ may allow at least two fingers of a user, for example a thumb and index finger of the user's hand, to pinch and pull the plurality of hair strands 50*a* and/or 50*b* through the opening 38. In one aspect, the length $L_O$ may be from 0.5 inches to 4 inches. In a further aspect, the length $L_O$ may be from 1 inch to 3 inches, or from 1.5 inches to 3.5 inches, or from 0.5 inches to 2.5 inches. In a further aspect, the length $L_O$ may be about 2.5 inches. To facilitate access of the opening and aid a user's ability to grasp and pull the plurality of hair strands 50*a* and/or 50*b* through the opening 38, the strip 30 may be comprised of an elastic material to allow the strip 30 to stretch and widen the opening 38 during use. In certain aspects, the strip 30 may be comprised of a stretch lace material. In certain aspects, the strip 30 may be comprised of the same material as the elongated body 20.

Figure 3:
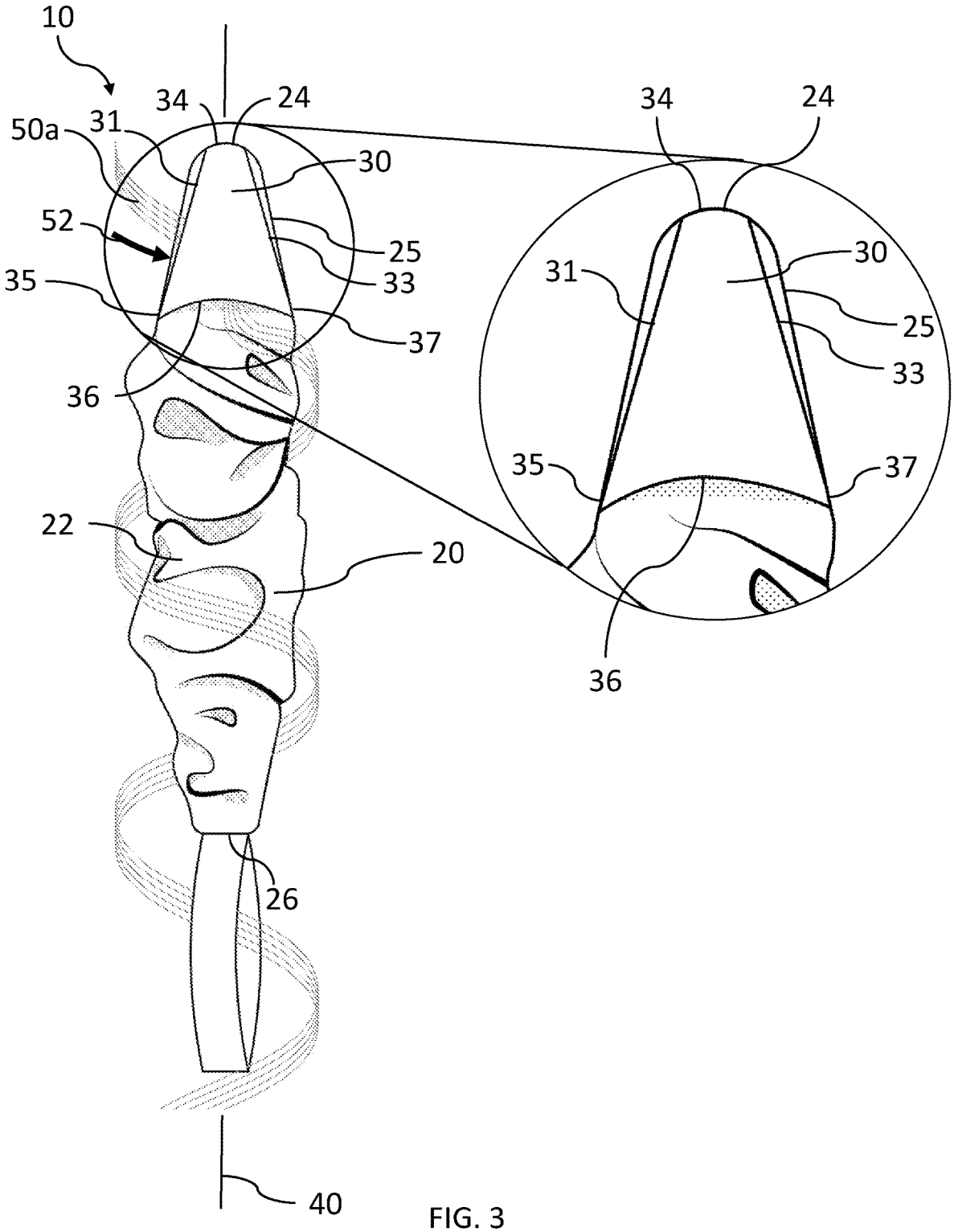
FIG. 3 shows a front view of an exemplary device for styling hair according to the invention.

As shown in FIG. 3, the strip 30 may comprise a first edge 31 and a second edge 33. Each edge 31, 33 may extend between the first end 34 and the second end 36 of the strip 30. In one aspect, the second end 36 of the strip 30 may be attached to the elongated body 20 proximate to the first edge 31 and the second edge 33, for example locations 35, 37 may be attached to the elongated body 20. The attached portions of the second end 36 of the strip 30 may extend along any direction, for example parallel, transverse, or diagonally with respect to the longitudinal axis. The second end 36 of the strip 30 between the attached locations 35, 37 may be detached. As shown in FIG. 3, the first plurality of hair strands 50*a* may be guided between an edge 31, 33 of the strip 30, in this example the first edge 31, and the elongated body 20 and through the opening 38 (shown in FIG. 2). The first plurality of hair strands 50*a* may exit the opening 38 through the detached portion of the second end 36 of the strip 30, in this example between locations 35, 37, and the elongated body 20, thereby guiding the first plurality of hair strands 50*a* through the opening at a downward angle to direct the first plurality of hair strands 50*a* around and along the elongated body 20 and to prevent the device for styling hair 10 from rolling when used.

Figure 4A:
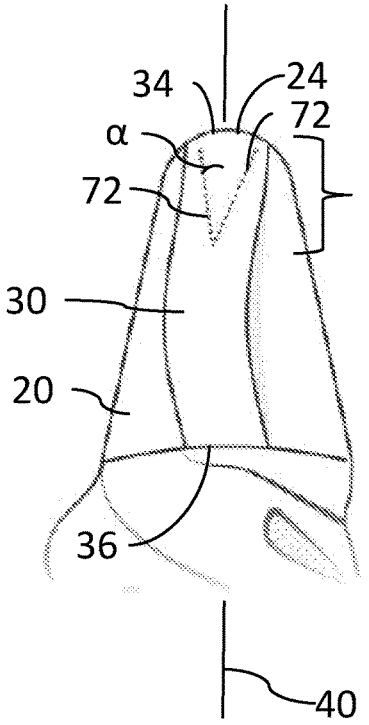
FIG. 4A shows an exemplary strip of the device for styling hair.
Figure 4B:
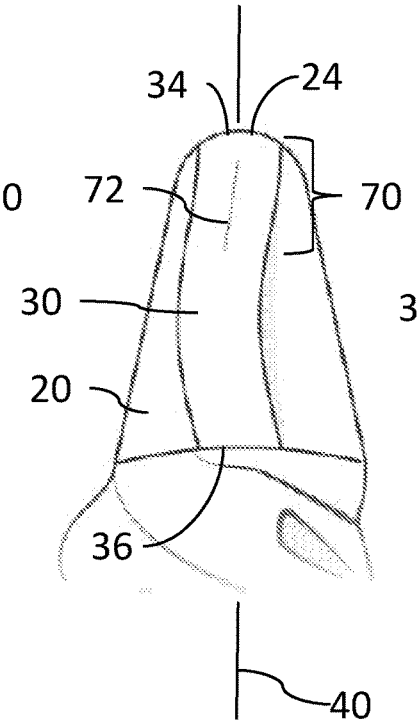
FIG. 4B shows an exemplary strip of the device for styling hair.
Figure 4C:
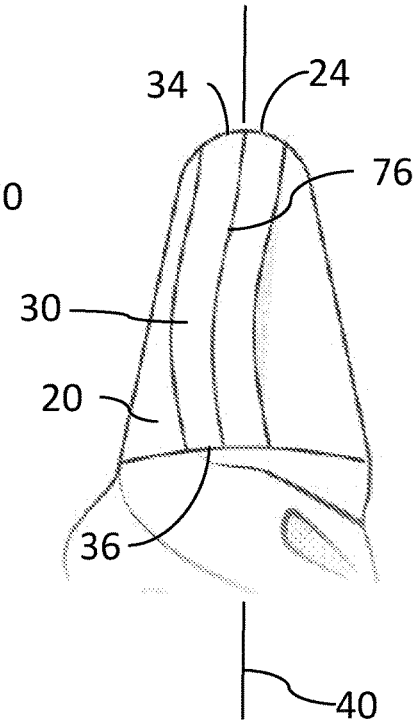
FIG. 4C shows an exemplary strip of the device for styling hair.

As shown in FIGS. 4A and 4B, a portion 70 of the strip 30 proximate to the first end 34 of the strip 30 may be permanently attached to the elongated body 20. In one aspect, the portion 70 of the strip 30 may be attached via fasteners 72 such as stitching, gluing, stapling, or adhesive. The fasteners 72 may define an end 39 of the opening 38 (shown in FIG. 2). As shown in FIG. 4A, the fasteners 72 may be angled, in this example the fasteners 72 can form a V-shape, to define the end 39 of the opening 38 at an angle $\alpha$ from 0 to 90 degrees with respect to the longitudinal axis 40. Although not shown, the fasteners 72 may define the end 39 of the opening 38 at an angle $\alpha$ by forming any angular shape, for example a straight angled line. In one aspect the angle $\alpha$ may be from 10 degrees to 80 degrees. In one aspect the angle $\alpha$ may be from 20 degrees to 70 degrees. In one aspect the angle $\alpha$ may be from 30 degrees to 60 degrees. In one aspect the angle $\alpha$ may be from 40 degrees to 50 degrees. The end 39 of the opening 38 defined at an angle $\alpha$ may guide the plurality of hair strands 50*a* and/or 50*b* through the opening at a downward angle to direct the plurality of hair strands 50*a* and/or 50*b* around and along the elongated body 20. As shown in FIG. 4B, the fasteners 72 may form a line extending along the longitudinal axis 40 to define the end 39 of the opening 38 below the first end 24 of the elongated body 20 and the first end 34 of the strip 30. The fasteners 72 may prevent the plurality of hair strands 50*a* and/or 50*b* extending through the opening 38 from moving in an upward direction or from slipping over the first end 24 of the elongated body 20. As shown in FIG. 4C, the strip 30 may comprise a wire 76. The wire 76 may provide structure to the strip 30 to better secure the plurality of hair strands 50*a* and/or 50*b* to the elongated body 20.

Figure 5:
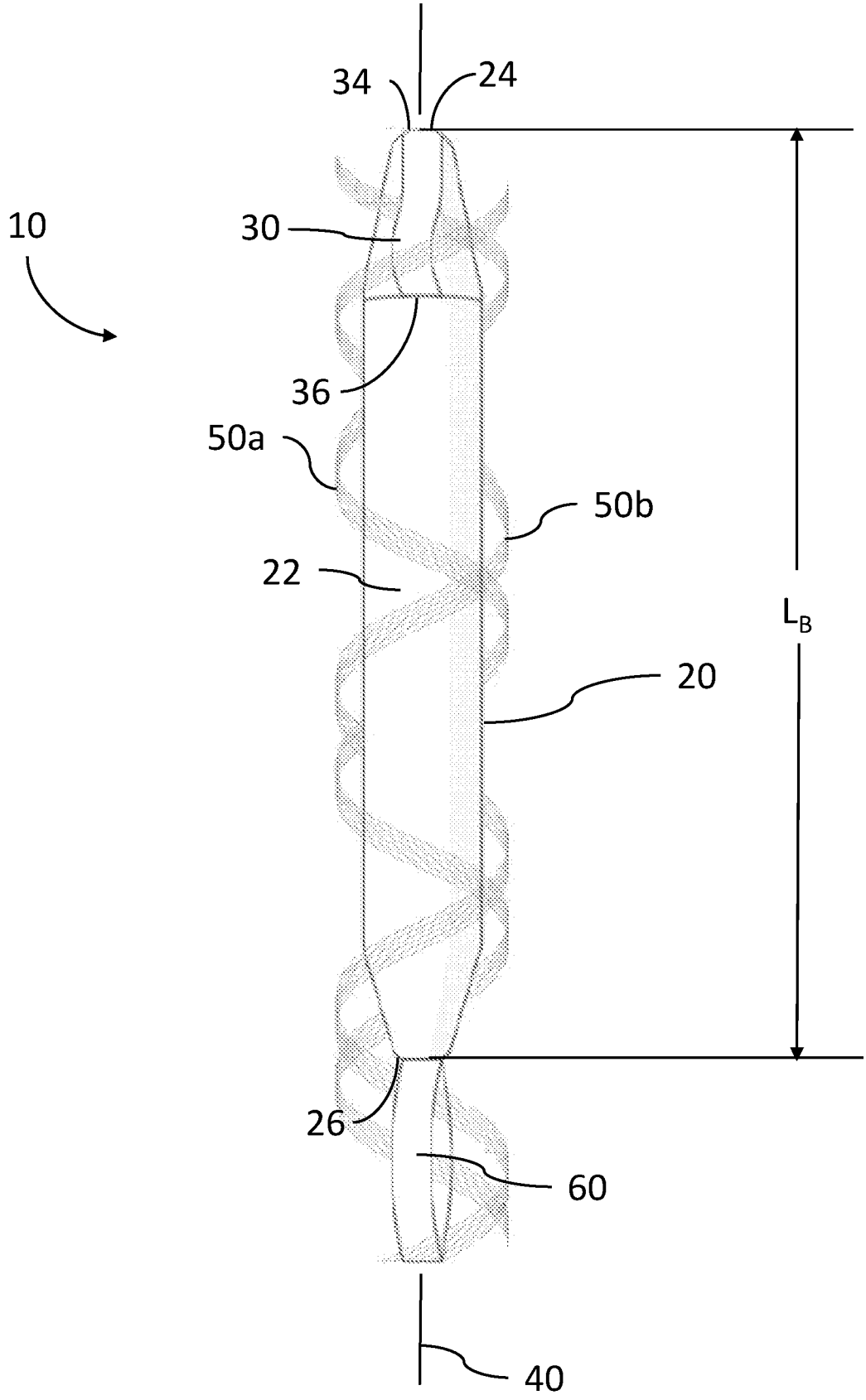
FIG. 5 shows a front view of an exemplary device for styling hair according to the invention.
Figure 6:
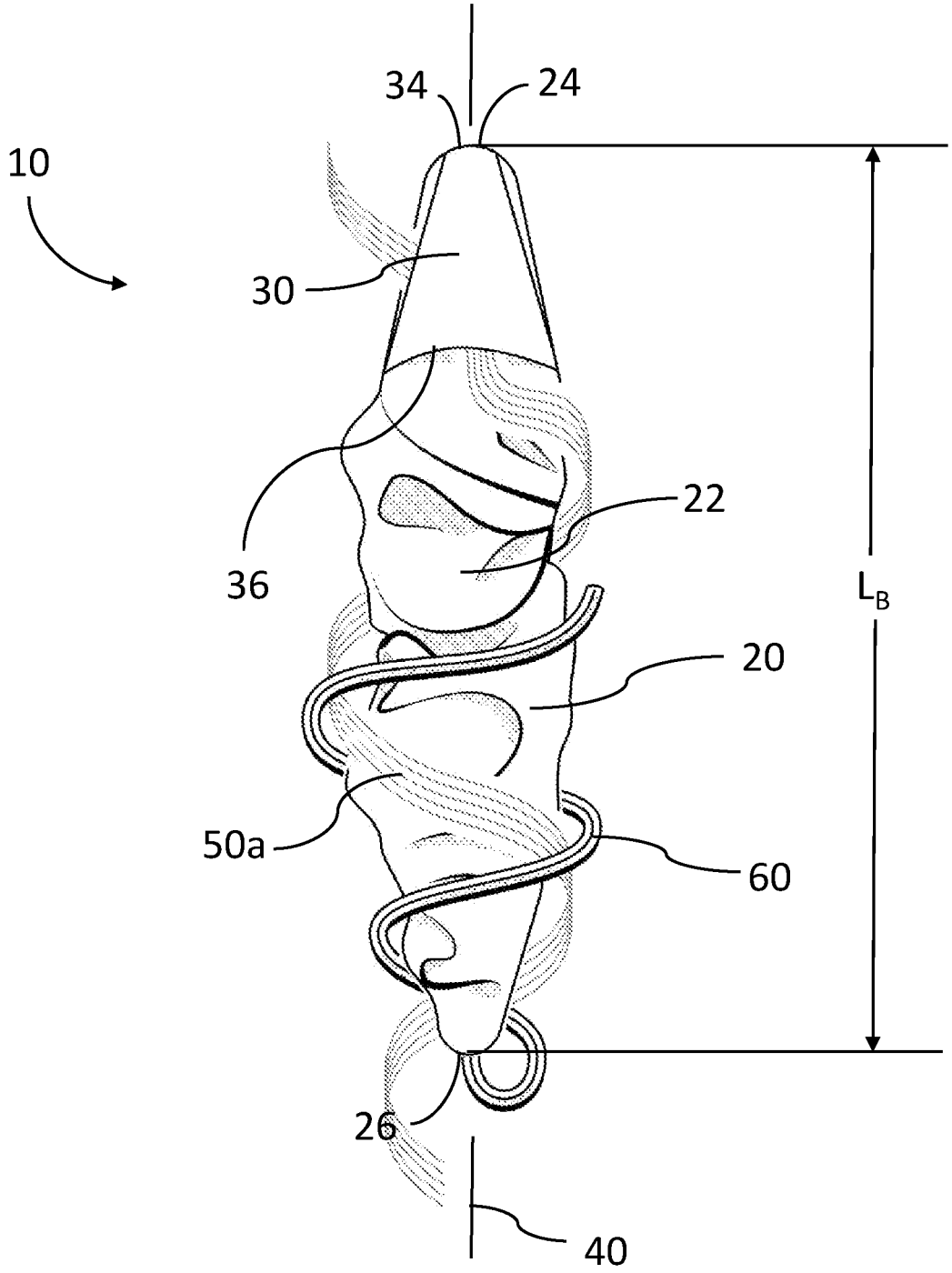
FIG. 6 shows a front view of an exemplary device for styling hair according to the invention.

After the plurality of hair strands 50*a* and 50*b* are wrapped around the elongated body 20, a fastener, such as a tie, pin, or clip, may be used to secure the wrapped hair strands 50*a*, 50*b* to the elongated body 20. Optionally, as shown in FIGS. 3, 5 and 6, the device for styling hair 10 may further comprise a hair fastener 60 coupled to the elongated body 20 proximate to the second end 26 of the elongated body 20 to secure the wrapped hair strands 50*a*, 50*b* to the elongated body 20. In one aspect, shown in FIG. 5, the hair fastener 60 may be a hair tie. In a further aspect, the hair tie may be an elastic, scrunchie, or silicon hair tie. In another aspect, shown in FIG. 6, the hair fastener 60 may comprise a wire adapted to be wrapped around the wrapped plurality of hair strands 50*a* and/or 50*b* along the elongated body 20. The hair fastener 60 comprising a wire may secure layered hair having different lengths wherein some strands of hair having a shorter length may not reach the second end 26 of the elongated body 20.

As shown in FIGS. 5 and 6, the elongated body 20 has a length $L_B$ extending along the longitudinal axis 40 between the first end 24 and the second end 26 of the elongated body 20. The length $L_B$ of the elongated body 20 may be designed to accommodate different lengths of hair. In one aspect, the length $L_B$ of the device for styling hair 10 may be designated mini, small, medium, large, or extra-large to accommodate corresponding hair lengths. In one aspect, the length $L_B$ may be from 3 inches to 30 inches. In one aspect, the length $L_B$ may be from 6 inches to 25 inches. In one aspect, the length $L_B$ may be from 10 inches to 20 inches.

Figure 7:
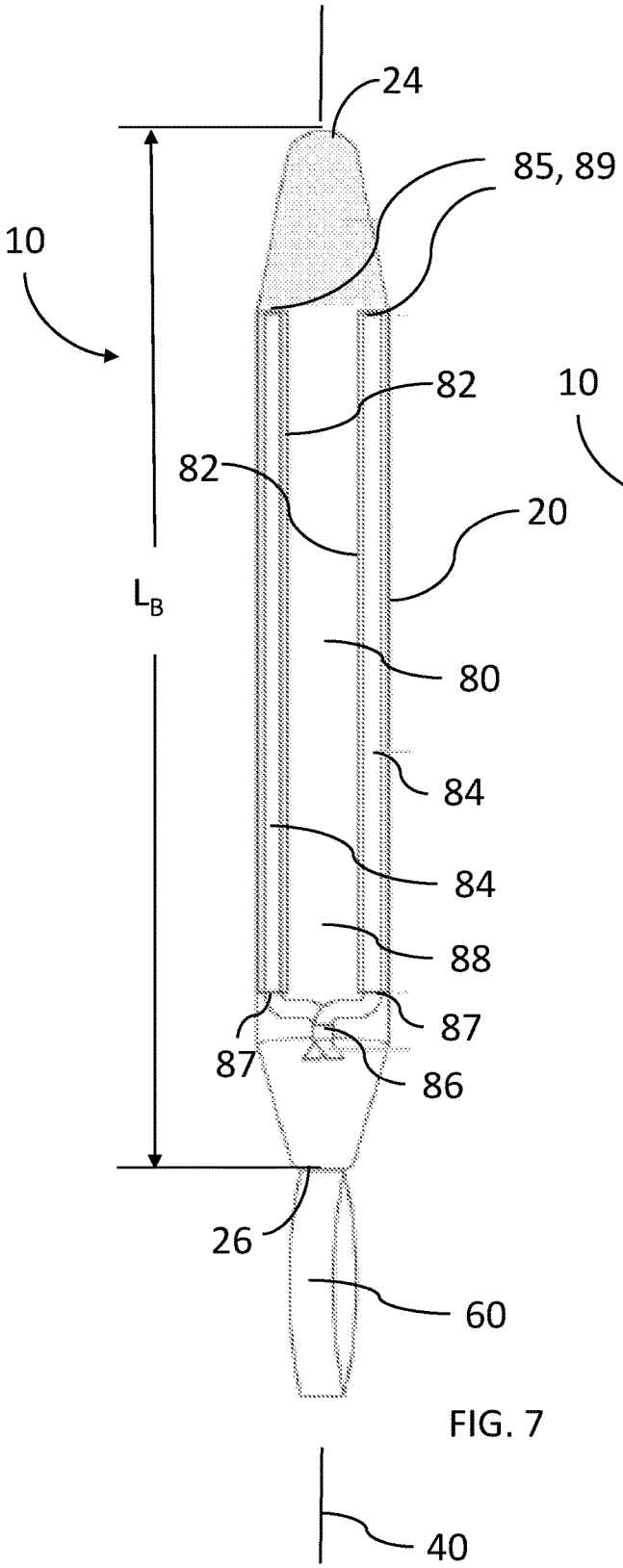
FIG. 7 shows an exemplary device for styling hair with a section view of an elongated body.
Figure 8:
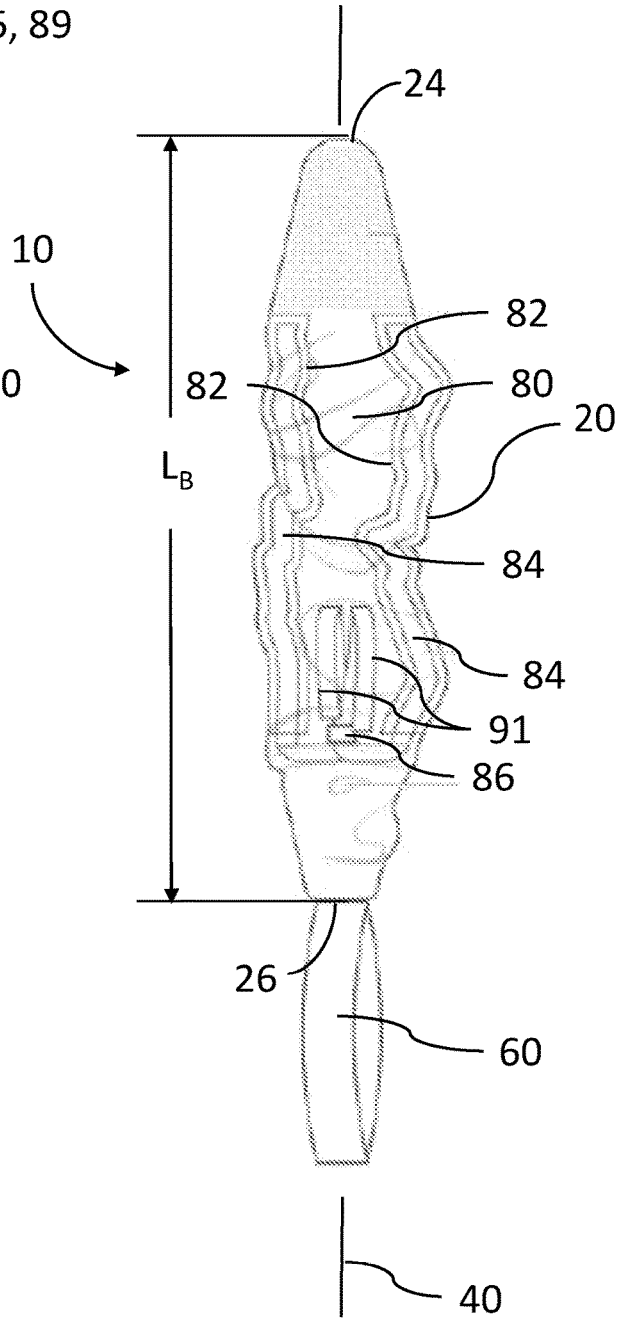
FIG. 8 shows the exemplary device for styling hair with a section view of the elongated body having an adjusted length.
Figure 9:
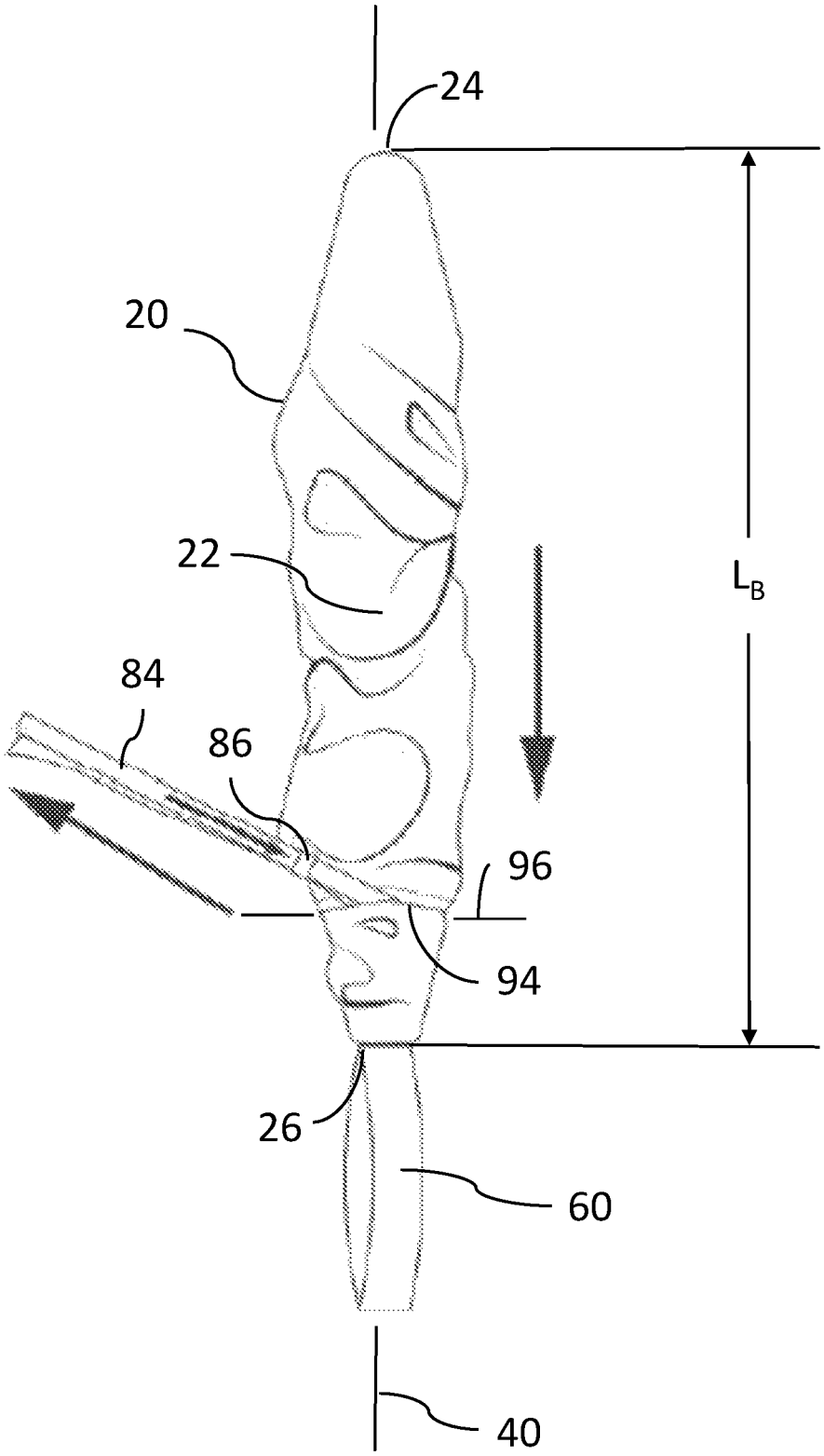
FIG. 9 shows a front view of an exemplary device for styling hair having an adjusted length.
Figure 10:
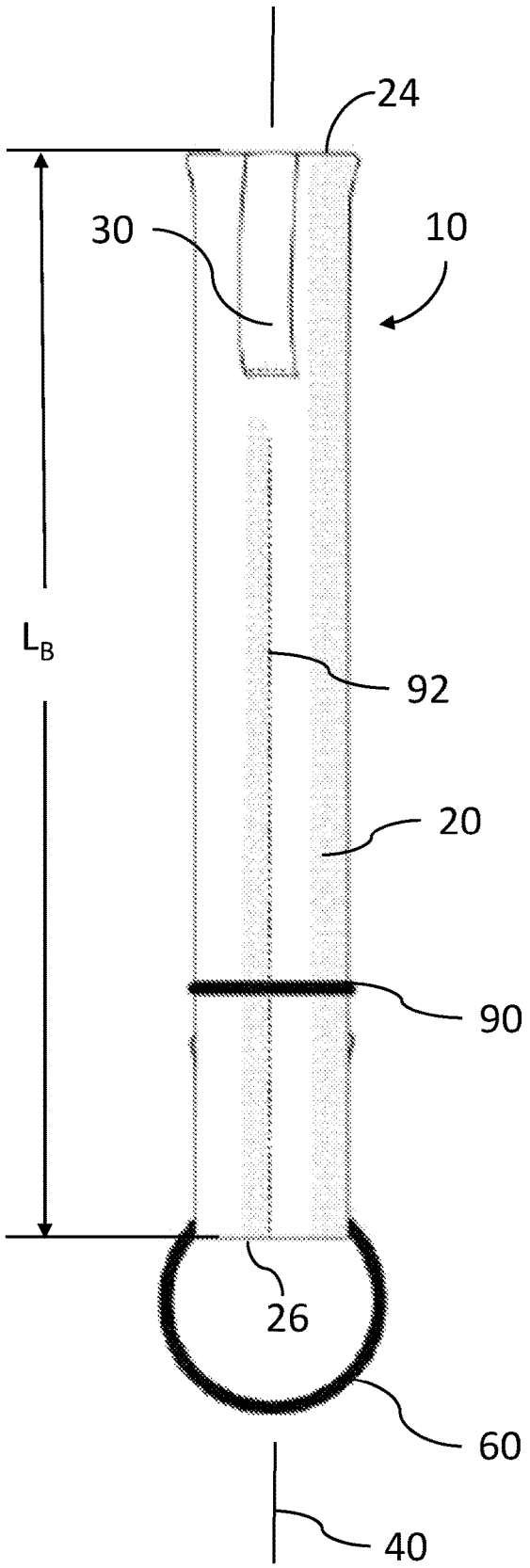
FIG. 10 shows a front view of an exemplary device for styling hair.
Figure 11:
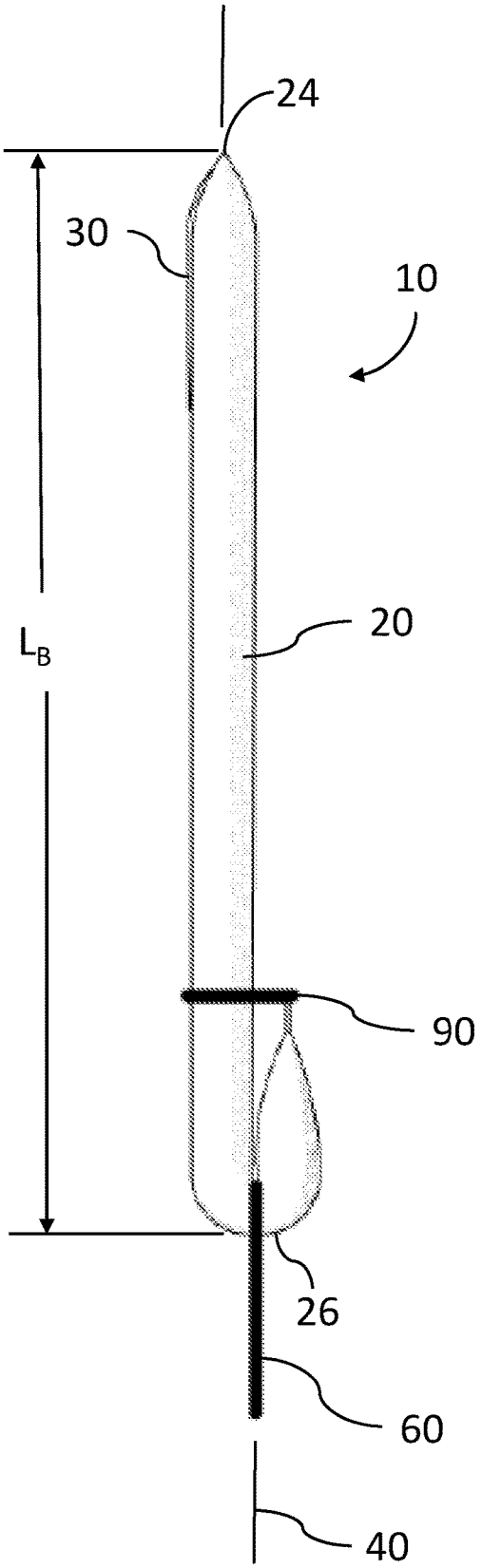
FIG. 11 shows a side view of the exemplary device for styling hair shown in FIG. 10.
Figure 12:
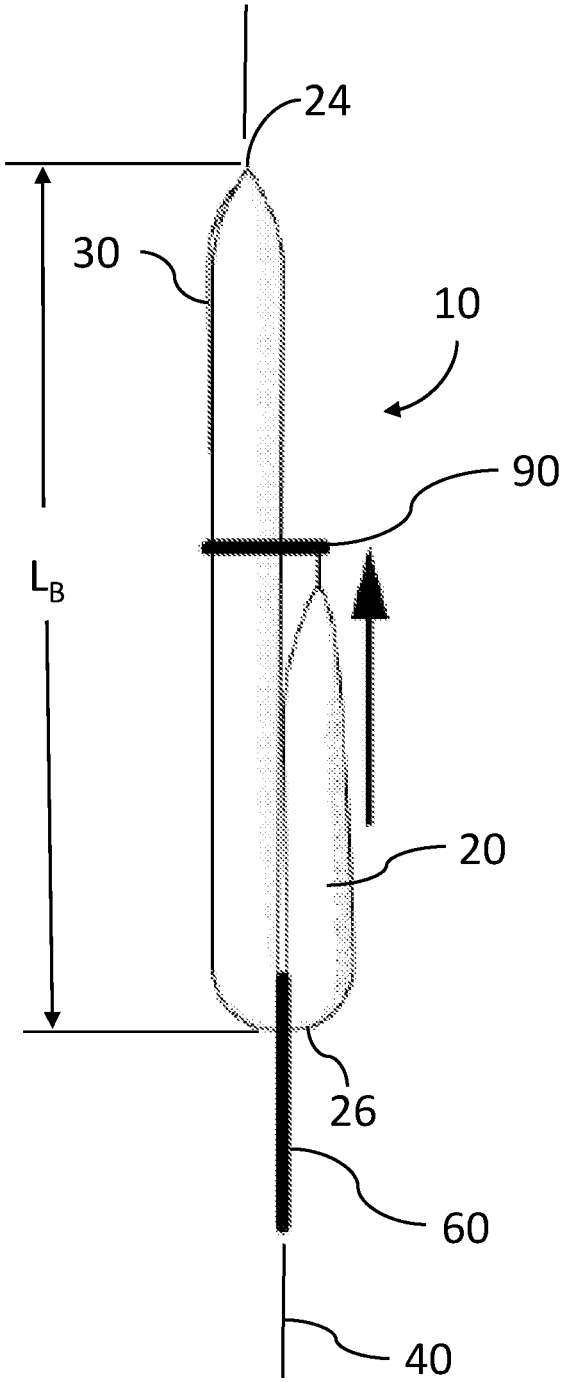
FIG. 12 shows a side view of the exemplary device for styling hair shown in FIG. 10 having an adjusted length.

As shown in FIGS. 7-9, the length $L_B$ of the elongated body 20 may be adjustable. In one aspect, the length $L_B$ of the elongated body 20 is adjustable from 4 inches to 30 inches. For example, the length $L_B$ of the elongated body 20 is adjustable from 3-15 inches to 6-30 inches. As shown in FIGS. 7 and 8 the elongated body 20 may comprise an interior space 80. In one aspect, as shown in FIG. 9, the interior space 80 may be accessible via a slit 94. The slit 94 may extend along a first axis 96. The first axis 96 may intercept the longitudinal axis 40. The first axis 96 may be transverse to the longitudinal axis 40. The first axis 96 may be angled with respect to the longitudinal axis 40. The interior space 80 may comprise at least one channel 82. In this example, the interior space 80 has two channels 82. Each channel 82 may comprise a cord 84 to adjust the length $L_B$ of the elongated body 20. In one aspect, the cord 84 may be a drawstring. A first end 85 of the cord 84 may be attached to a first end 89 of the channel 82. In one aspect, the first end 85 of the cord 84 is sewn to the first end 89 of the channel 82. The cord 84 may extend through and beyond a second end 87 of the channel 82. Each cord 84 may extend through a pull tab 86 as shown in FIG. 7 to hold the cord(s) 84 tight at a desired location and hold the second end 87 of the channel 82 at a position along the cord(s) 84 thereby maintaining the adjusted length $L_B$ of the elongated body 20. The pull tab 86 may be a cord lock known in the art. In one aspect, the pull tab 86 may be coupled to an interior surface 88 of the elongated body 20 proximate to the first end 24 of the elongated body 20 to allow the cord(s) 84 and pull tab 86 to be easily accessible to a user. As shown in FIG. 9, the length $L_B$ may be shortened by accessing the cords 84 via the slit 94 and pulling the cords 84 relative to the pull tab 86. As shown in FIG. 8, the loose ends 91 of the cords 84 may be tucked into the interior space 80 when the length $L_B$ is not being adjusted so that the cords 84 do not get caught in the wrapped plurality of hair strands 50*a*, 50*b*. Alternatively, as shown in FIGS. 10-12, the length $L_B$ may be adjusted by folding or unfolding the elongated body 20. A band 90 encompassing the elongated body 20 may be used to secure the elongated body 20 in a folded position to maintain a desired length $L_B$.

Figure 13A:
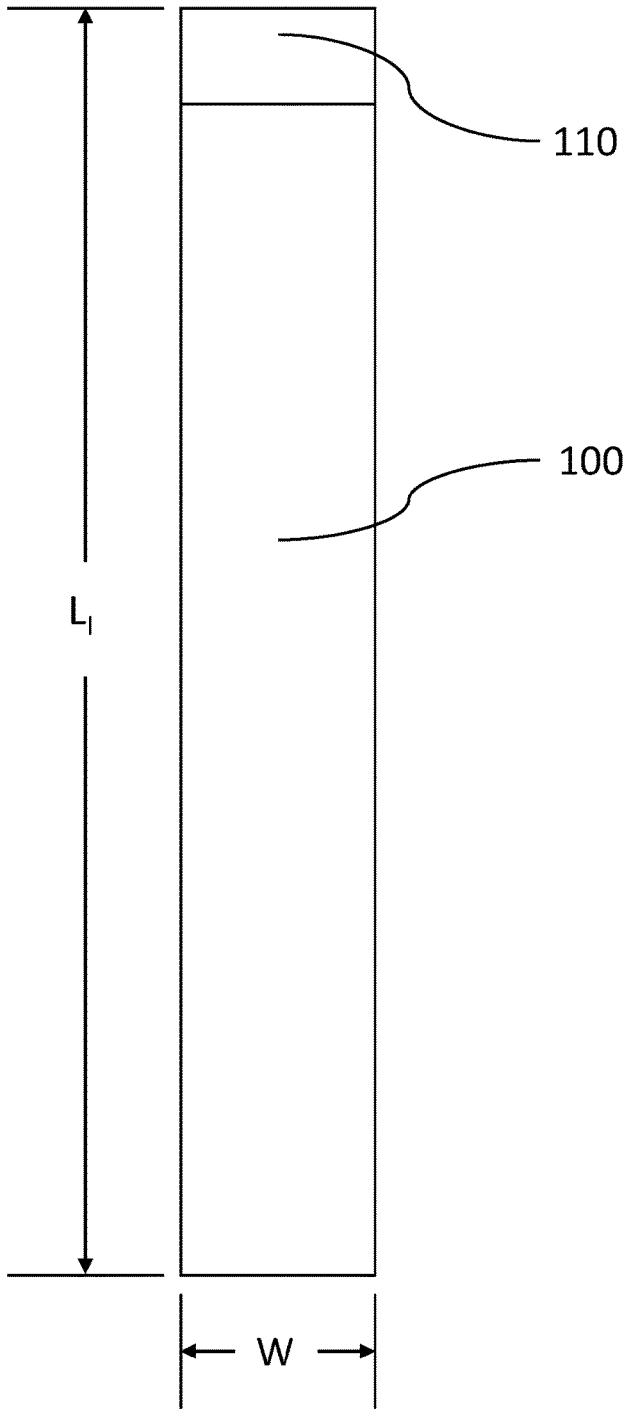
FIG. 13A shows a front view of an exemplary elongated insert.
Figure 14:
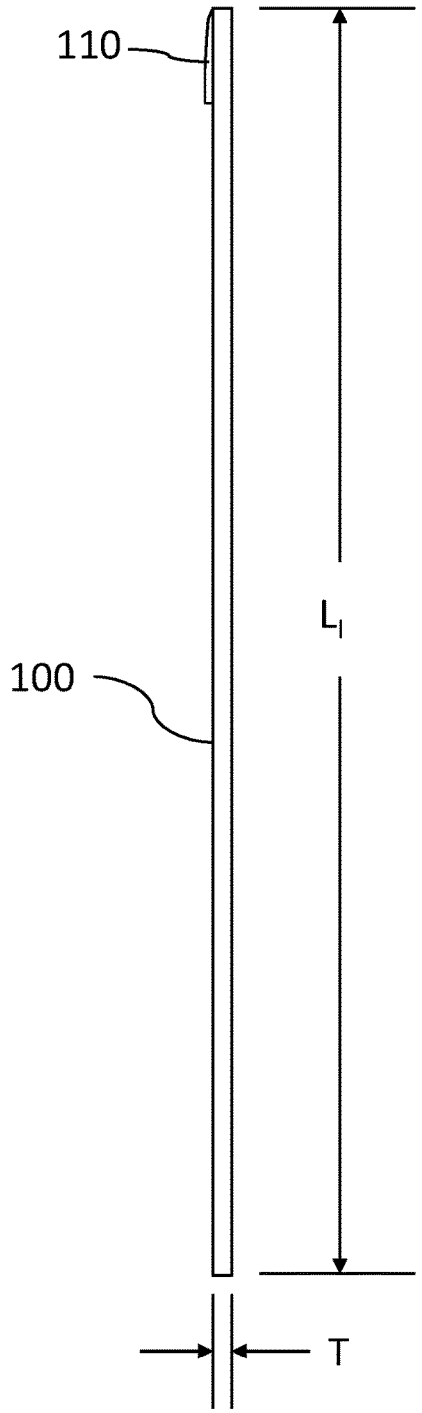
FIG. 14 shows a side view of the exemplary elongated insert shown in FIG. 13A.
Figure 13B:
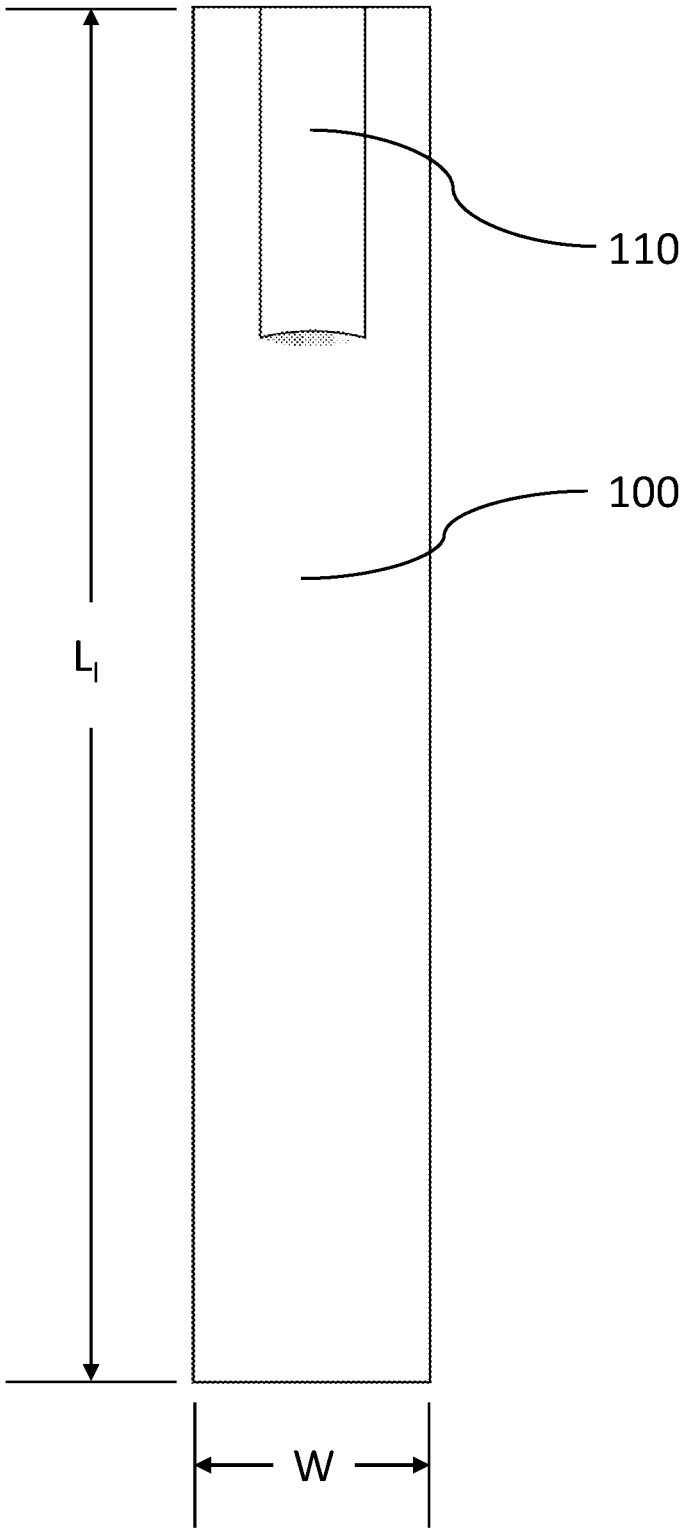
FIG. 13B shows a front view of an exemplary elongated insert.

The interior space 80 may be adapted to receive an elongated insert 100 (shown in FIGS. 13A-14) positionable between the first end 24 and the second end 26 of the elongated body 20. The elongated insert 100 may provide structure and shape to the elongated body 20. The elongated insert 100 may be secured within the interior space 80, for example the elongated body 20 may be sewn with the elongated insert 100 fixed within as shown in FIGS. 10-12. In one aspect, the interior space 80 may be accessible. In further aspects, the elongated insert 100 may be inserted into the interior space 80 through the slit 94. The elongated insert 100 may comprise a sleeve 110, shown in FIGS. 13A and 13B, adapted to receive a tool to insert the elongated insert 100 into the interior space 80 through the slit 94. In one aspect, the tool may be a rod. The interior space 80 may be adapted to receive at least one of a plurality of elongated inserts, each insert 100 of the plurality of elongated inserts may have at least one of a width W, a thickness T, or a length $L_I$ different from other inserts of the plurality of elongated inserts. An insert 100 having a specific width W, thickness T and length $L_I$ may be selected from the plurality of inserts based on a desired curl size. For example, a user may select an insert 100 having a large width W, thickness T, and/or length $L_I$ as compared to inserts 100 having smaller widths, thicknesses, and/or lengths to create larger diameter curls. In one aspect, at least a portion of the elongated insert 100 may be made from an absorbent material to wick and absorb moisture from the plurality of hair strands 50*a*, 50*b*. In one aspect, the elongated insert 100 may be made from cotton. In one aspect, the elongated insert 100 and/or the elongated body 20 may be heated and used to more quickly curl the plurality of hair strands 50*a*, 50*b*. In certain aspects, at least one of the elongated body 20 or the elongated insert 100 is made of a microwavable and heat retaining material. A microwavable material may be any material that is safely heated in a microwave. In one aspect, the elongated insert 100 may be comprised of at least one of rice, flaxseed, wheat berries, corn, pearl barley, organic cherry pits, clay beads, steel-cut oats, walnut shells, lava sand, or gel beads, or a combination thereof. In a further aspect, the elongated insert 100 may be only partially filled to allow the elongated body 20 and the elongated insert 100 to fold to adjust the length $L_B$ of the elongated body 20. Further, the elongated body 20 may comprise a seam 92 extending along the longitudinal axis 40 to disperse the elongated insert 100 within the interior space 80 and to prevent the material within the elongated insert 100 from collecting at the second end 26 of the elongated body 20 due to gravity.

Figure 15:
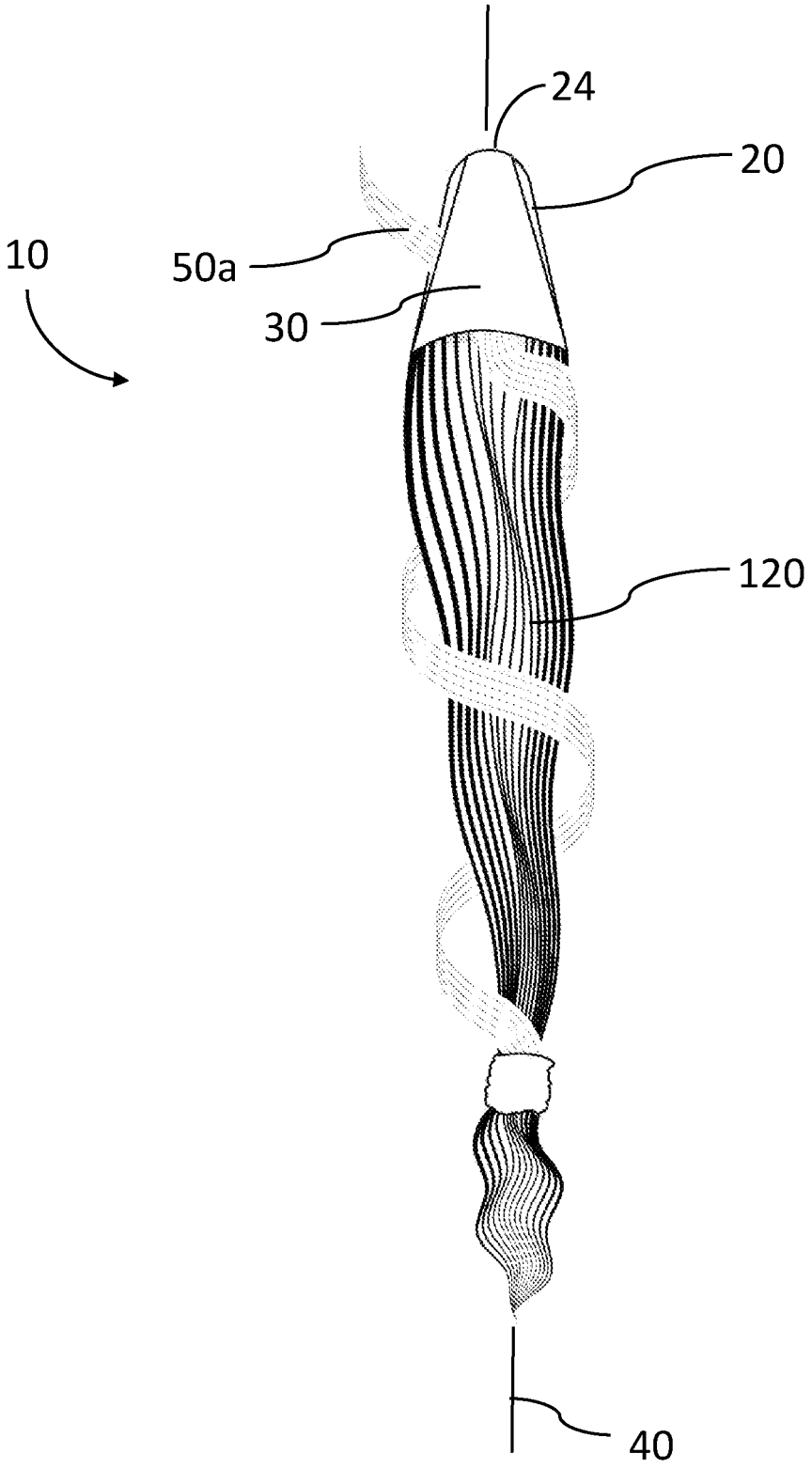
FIG. 15 shows a front view of an exemplary device for styling hair according to the invention.

As shown in FIG. 15, the device for styling hair 10 may comprise fibers 120. The fibers 120 may be natural or synthetic. In one aspect, the natural fibers may be hair. In a further aspect, the hair may be real or natural hair. In one aspect, the synthetic fibers may include synthetic hair. The fibers 120, may be attached to the elongated body 20. In one aspect, the fibers 120 may be permanently attached. Alternatively, the fibers 120 may be removably attached. The fibers 120 may extend along the longitudinal axis 40. In one aspect, the fibers 120 may be partially braided to provide structure. In a further aspect, the braid may be a rounded pattern to provide a cylinder shaped curl. A user's plurality of hair strands 50*a* and/or 50*b* may be wrapped around the fibers 120 of the device for styling hair 10. This aspect may allow the device for styling hair 10 to serve as a hair curler and a hair extension. Further, this aspect may camouflage the device for styling hair 10 with the user's plurality of hair strands 50*a* and/or 50*b*.

Figure 16:
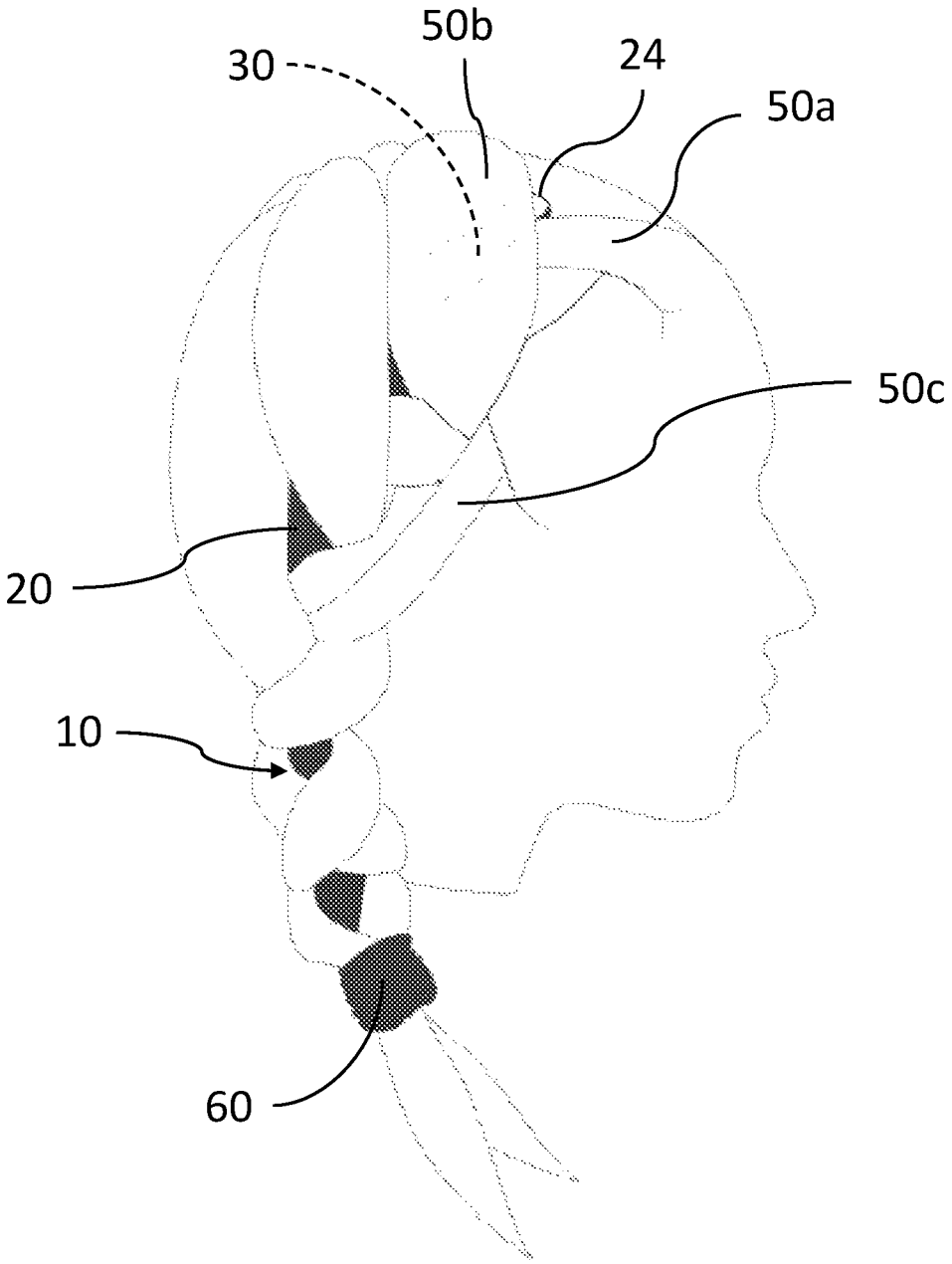
FIG. 16 shows an exemplary device for styling hair in use.

In still further aspects, disclosed herein are methods of using the device for styling hair 10. The device for styling hair 10 may be used to style hair including real hair, synthetic hair, or a combination. With reference to FIG. 16, the method of use comprises the step of pulling a first plurality of hair strands 50*a* through the opening 38 of the strip 30. The first plurality of hair strands 50*a* may be pulled through the opening 38 until the first end 24 of the elongated body 20 is positioned proximate to roots of the first plurality of hair strands 50*a*. The method also comprises wrapping the first plurality of hair 50*a* around the elongated body 20 in a first direction 52. The method further comprises wrapping a second plurality of hair strands 50*b* around the elongated body 20 in a second direction 54 different than the first direction 52. Further, the method comprises securing the wrapped first plurality of hair strands 50*a* and second plurality of hair strands 50*b* with a fastener. The method may further comprise wrapping a third plurality of hair strands 50*c* around the elongated body 20 in the first direction 52, wherein strands of the first plurality of hair strands 50*a*, strands of the second plurality of hair strands 50*b* and strands of the third plurality of hair strands 50*c* are wrapped around the elongated body 20 in an alternating fashion to create a braid around the elongated body 20. The third plurality of hair strands 50*c* may also be secured with the fastener.

In one aspect, the method may further comprise inserting the elongated insert 100 into the interior space 80 of the elongated body 20 between the first end 24 and the second end 26 of the elongated body 20.

In a further aspect, the method may comprise heating the elongated body 20. In one aspect, the method may comprise heating the elongated body 20 and the elongated insert 100. Alternatively, the elongated insert 100 may be heated prior to inserting the elongated insert 100 into the interior space 80.

In certain aspects, the method may further comprise adjusting the length $L_B$ of the elongated body 20.

In another aspect, the method may comprise wetting the plurality of hair strands 50*a*, 50*b*, 50*c*.

The method may comprise leaving the plurality of hair strands 50*a*, 50*b*, 50*c* wrapped around and secured to the device for styling hair 10 for several hours. In one aspect, the device 10 may be worn overnight. In another aspect, the device 10 may be worn for 5 min to 24 hours. For example, the device for styling hair 10 is worn for 2 hours to 12 hours. After the device for styling hair 10 is removed, the plurality of hair strands 50*a*, 50*b*, 50*c* may appear curly, wavy, or blown out. One or more devices for styling hair 10 may be worn to style a head of hair, a wig, or a combination of synthetic and real hair.

While certain exemplary aspects of the invention have been described and disclosed, it will be apparent to those skilled in the art that various changes and modifications may be made that will achieve some or even all of the advantages of the invention without departing from the spirit and scope of the invention.

What is claimed is:

1. A device for styling hair, the device comprising:

an elongated body extending along a longitudinal axis and having an outer surface, a first end, and a second end oppositely disposed to the first end, wherein the elongated body is adapted to receive a plurality of hair strands wrapped around the outer surface between the first end and the second end, wherein the elongated body comprises a first portion and a second portion, the first portion being proximate to the first end and defining a first length; and a strip having a length and a width, wherein the length is longer than the width, wherein the length of the strip extends in a direction of the longitudinal axis from a first end of the strip to a second end of the strip, wherein the first end and the second end of the strip are each individually attached directly to the outer surface of the elongated body and spaced apart longitudinally along the elongated body proximate to the first portion of the elongated body, with a portion of the first end and a portion of the second end of the strip being permanently attached to the outer surface of the first portion of the elongated body, and wherein the elongated body further comprises a second portion extending from the second end of the strip to the second end of the elongated body, wherein the second portion has a second length that is longer than the first length of the first portion, wherein the strip has an inner surface, the inner surface of the strip facing a portion of the outer surface of the first portion of the elongated body to define an opening therebetween, the opening having a length extending along the longitudinal axis, the opening adapted to receive the plurality of hair strands and secure the hair strands between the inner surface of the strip and the portion of the outer surface of the first portion of the elongated body.

2. The device for styling hair according to claim 1, wherein the strip comprises a first edge and a second edge, wherein the second end of the strip is attached to the elongated body proximate to the first edge and the second edge and the second end of the strip is detached therebetween.

3. The device for styling hair according to claim 1, wherein the elongated body comprises fibers extending along the longitudinal axis.

4. The device for styling hair according to claim 1 further comprising a hair fastener coupled to the elongated body proximate to the second end of the elongated body to secure the wrapped hair strands to the elongated body.

5. The device for styling hair according to claim 1, wherein the length of the opening is from 0.5 inch to 4 inches.

6. The device for styling hair according to claim 1, wherein the portion of the strip that is permanently attached to the elongated body is attached with at least one of stitching, gluing, stapling, or adhesive, wherein the at least one of stitching, gluing, stapling, or adhesive defines an end of the opening, the end being angled from 0 to 90 degrees with respect to the longitudinal axis.

7. The device for styling hair according to claim 1, wherein the portion of the strip that is permanently attached to the elongated body is attached with at least one of stitching, gluing, stapling, or adhesive, wherein the at least one of stitching, gluing, stapling, or adhesive forms a line extending along the longitudinal axis to define an end of the opening below the first end of the elongated body and the first end of the strip.

8. The device for styling hair according to claim 1, wherein the strip is comprised of an elastic material.

9. The device for styling hair according to claim 1, wherein the elongated body comprises an interior space.

10. The device for styling hair according to claim 9, further comprising a slit extending along a first axis to provide access to the interior space.

11. The device for styling hair according to claim 9, wherein the interior space is adapted to receive an elongated insert positionable between the first end and the second end of the elongated body.

12. The device for styling hair according to claim 11, wherein at least one of the elongated body or the elongated insert is made of a microwavable and heat retaining material.

13. The device for styling hair according to claim 11, wherein the elongated body further comprises a seam extending along the longitudinal axis to disperse the elongated insert within the interior space.

14. The device for styling hair according to claim 9, wherein the interior space is adapted to receive at least one of a plurality of elongated inserts, each insert of the plurality of elongated inserts has at least one of a width, a thickness, or a length different from other inserts of the plurality of elongated inserts.

15. The device for styling hair according to claim 1, wherein the elongated body has a length extending along the longitudinal axis between the first end and the second end of the elongated body, wherein the length of the elongated body is adjustable.

16. The device for styling hair according to claim 15, wherein the elongated body comprises an interior space, the interior space comprising at least one channel comprising a cord to adjust the length of the elongated body.

17. The device for styling hair according to claim 1, wherein the first portion of the elongated body is tapered approaching the first end of the elongated body.

18. A method of styling hair using the device of claim 1, the method comprising the following steps:

pulling a first plurality of hair strands through the opening;

wrapping the first plurality of hair strands around the elongated body in a first direction;

wrapping a second plurality of hair strands around the elongated body in a second direction different than the first direction; and securing the wrapped first plurality of hair strands and second plurality of hair strands with a fastener.

19. The method of styling hair according to claim 18, wherein the method further comprises wrapping a third plurality of hair strands around the elongated body in the first direction, wherein strands of the first plurality of hair strands, strands of the second plurality of hair strands and strands of the third plurality of hair strands are wrapped around the elongated body in an alternating fashion.

* * * * *